US012422160B2

(12) United States Patent
Kang et al.

(10) Patent No.: US 12,422,160 B2
(45) Date of Patent: Sep. 23, 2025

(54) APPARATUS FOR CONTROLLING FAN MOTOR, AIR CONDITIONING SYSTEM AND CONSTANT AIRFLOW CONTROL METHOD OF APPARATUS FOR CONTROLLING FAN MOTOR

(71) Applicant: LG ELECTRONICS INC., Seoul (KR)

(72) Inventors: Jeonggu Kang, Seoul (KR); Cheolmin Cho, Seoul (KR); Jihyun Ahn, Seoul (KR); Moonho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 483 days.

(21) Appl. No.: 18/080,998

(22) Filed: Dec. 14, 2022

(65) Prior Publication Data

US 2023/0235915 A1 Jul. 27, 2023

(30) Foreign Application Priority Data

Jan. 21, 2022 (KR) ..... 10-2022-0009296

(51) Int. Cl.

| | |
|---|---|
| ***F24F 3/02*** | (2006.01) |
| ***F24F 11/64*** | (2018.01) |
| ***F24F 11/75*** | (2018.01) |
| ***F24F 11/77*** | (2018.01) |
| ***F24F 11/88*** | (2018.01) |

(52) U.S. Cl.

CPC ..... *F24F 11/75* (2018.01); *F24F 11/64* (2018.01); *F24F 11/77* (2018.01); *F24F 11/88* (2018.01)

(58) Field of Classification Search

CPC .. F24F 11/75; F24F 11/64; F24F 11/77; F24F 11/88; F24F 11/54; F24F 3/02; H02P 27/08

See application file for complete search history.

(56) References Cited

U.S. PATENT DOCUMENTS

| | | | | |
|---|---|---|---|---|
| 5,039,009 | A * | 8/1991 | Baldwin | G05D 23/1912 62/298 |
| 8,493,008 | B2 * | 7/2013 | Merkel | F24F 11/67 318/400.18 |
| 10,816,233 | B2 | 10/2020 | Muniganti et al. | |
| 10,976,069 | B2 * | 4/2021 | Song | F24F 11/49 |
| 2007/0012052 | A1 * | 1/2007 | Butler | F24F 11/65 62/181 |
| 2008/0000246 | A1 * | 1/2008 | Ha | G05D 23/1913 62/228.1 |
| 2008/0277486 | A1 * | 11/2008 | Seem | H04L 67/125 236/49.3 |
| 2009/0261767 | A1 * | 10/2009 | Butler | F24F 11/77 318/445 |

(Continued)

*Primary Examiner* — Yongjia Pan
(74) *Attorney, Agent, or Firm* — KED & ASSOCIATES

(57) ABSTRACT

A motor control apparatus may relate to a motor control apparatus, an air conditioning system, and a constant airflow control method of a fan motor control apparatus of an indoor unit, in which table information on an airflow command value corresponding to a reception pattern or type of a signal is prestored to determine a corresponding airflow command value from the table information according to a result of receiving the signal from a central control apparatus so as to control an operation of a fan motor.

19 Claims, 10 Drawing Sheets

(56) References Cited

U.S. PATENT DOCUMENTS

| | | | | |
|---|---|---|---|---|
| 2010/0114382 | A1* | 5/2010 | Ha | F24F 11/62 700/276 |
| 2010/0298983 | A1* | 11/2010 | Beste | G05B 13/00 29/890.035 |
| 2011/0260671 | A1* | 10/2011 | Jeung | H02P 6/08 29/402.08 |
| 2012/0227928 | A1* | 9/2012 | Green | F24F 11/30 703/2 |
| 2013/0084192 | A1* | 4/2013 | Lee | F04D 27/004 417/32 |
| 2014/0014291 | A1* | 1/2014 | Kraft | F24F 11/30 165/247 |
| 2014/0371918 | A1* | 12/2014 | Douglas | F24F 11/30 700/276 |
| 2015/0362207 | A1* | 12/2015 | Abiprojo | F24F 11/67 702/183 |
| 2016/0268935 | A1* | 9/2016 | Hu | H02P 6/08 |
| 2018/0031267 | A1* | 2/2018 | Hern | F25D 21/04 |
| 2018/0252425 | A1* | 9/2018 | Laughman | F24F 11/77 |
| 2018/0356847 | A1* | 12/2018 | Mohalley | F24F 11/77 |
| 2019/0277527 | A1* | 9/2019 | Muniganti | F24F 11/58 |
| 2020/0356150 | A1* | 11/2020 | Chuang | H03K 7/08 |
| 2022/0099100 | A1* | 3/2022 | Pearson | F04D 27/004 |

* cited by examiner

FIG. 7

| FIRST COMMUNICATION LINE | SECOND COMMUNICATION LINE | THIRD COMMUNICATION LINE | FOURTH COMMUNICATION LINE | FIFTH COMMUNICATION LINE | AIRFLOW COMMAND VALUE |
|---|---|---|---|---|---|
| 0 | 0 | 0 | 0 | 0 | 0 |
| 0 | 0 | 0 | 0 | 1 | 100CFM(10%) |
| ⋮ | ⋮ | ⋮ | ⋮ | ⋮ | ⋮ |
| 1 | 1 | 1 | 1 | 0 | 900CFM(90%) |
| 1 | 1 | 1 | 1 | 1 | 1000CFM(100%) |

| PWM | AIRFLOW COMMAND VALUE |
|---|---|
| 10% | 1000CFM |
| 20% | 1200CFM |
| ⋮ | ⋮ |
| 90% | 2000CFM |

APPARATUS FOR CONTROLLING FAN MOTOR, AIR CONDITIONING SYSTEM AND CONSTANT AIRFLOW CONTROL METHOD OF APPARATUS FOR CONTROLLING FAN MOTOR

CROSS-REFERENCE TO RELATED APPLICATION

This application claims the benefit of the earlier filing date and the right of priority under 35 U.S.C. § 119(a) to Korean Patent Application No. 10-2022-0009296, filed in Korea on Jan. 21, 2022, the contents of which are incorporated by reference herein in their entirety.

BACKGROUND

1. Field

Embodiments may relate to a motor control apparatus that controls a fan motor of an indoor unit, an air conditioning system including the same, and/or a constant airflow method of a fan motor control apparatus of an indoor unit.

2. Background

Background technology may relate to constant airflow control of an air conditioning system and communication/control for the same.

A heating ventilation air conditioning (HVAC) air conditioning system that performs air conditioning for a plurality of rooms through a duct may supply airflow to the plurality of rooms from a single indoor unit through the duct to perform air conditioning. In such an air conditioning system, in order to perform air conditioning of the plurality of rooms with a single indoor unit, importance of constant airflow supply control is emphasized. The fan motor of the indoor unit (of the air conditioning system) uses an electronically commutated motor (ECM) or brushless direct current (BLDC) motor. U.S. Pat. No. 10,816,233 B2 (published on Oct. 27, 2020) (Document 1), the subject matter of which is incorporated herein by reference, provides a signal processing apparatus for controlling a motor speed, a constant torque, and constant airflow. The control of a motor for controlling airflow in Document 1 may be as shown in FIGS. 1 and 2.

FIG. 1 is an exemplary diagram showing a configuration of constant torque control in an air conditioning system. FIG. 2 is an exemplary diagram showing a configuration of constant airflow control in an air conditioning system.

In the constant torque control of the air conditioning system, as shown in FIG. 1, a central control apparatus 220 (corresponding to a main control board) transfers control commands to a motor control apparatus 230 corresponding to an inverter apparatus through a plurality of communication lines, which is carried out such that different command values are transferred for respective communication lines. In such a control method, the central control apparatus 220 directly transmits a result of directly calculating coefficients of the control commands to the motor control apparatus 230. Thus, a configuration is provided for high-performance operation/communication processing in each of the central control apparatus 220 and the motor control apparatus 230. Furthermore, when a problem occurs in any one of the communication lines, there may be a problem that accurate control cannot be achieved since a control command is transferred inaccurately due to a communication error.

On the other hand, in the constant airflow control of the air conditioning system shown in FIG. 2, the central control apparatus 220 (corresponding to the main control board) bidirectionally communicates with the motor control apparatus 230 corresponding to the inverter apparatus through a MODBUS communication method, and the like to transmit and receive information for constant airflow control. In order to control the constant airflow, various parameter information and control information such as a constant airflow command, a constant airflow coefficient, an estimated power coefficient, estimated power, and a constant airflow power error may be required. The central control apparatus 220 may bidirectionally communicate with the motor control apparatus to transmit and receive such information. Such a communication/control method has a limitation in that a configuration for high-performance calculation/communication processing is required in each of the central control apparatus 220 and the motor control apparatus 230 as various data are calculated and transmitted/received.

As such, in disadvantageous arrangements, a high-performance calculation/communication element may be needed according to a large amount of data transmission and two-way communication method. Accordingly, there is a limitation in that a large amount of cost is consumed in construction and design of the air conditioning system. Additionally, when a calculation is performed in each control apparatus and a problem occurs in a communication line, there may be a risk that the control cannot be carried out accurately, thereby causing a problem of limiting the stability and reliability of air conditioning.

BRIEF DESCRIPTION OF THE DRAWINGS

Embodiments may be described in detail with reference to the following drawings in which like reference numerals refer to like elements, and wherein:

FIG. 7 is an exemplary diagram of table information according to the embodiment shown in FIG. 6;

DETAILED DESCRIPTION

Figure 1:
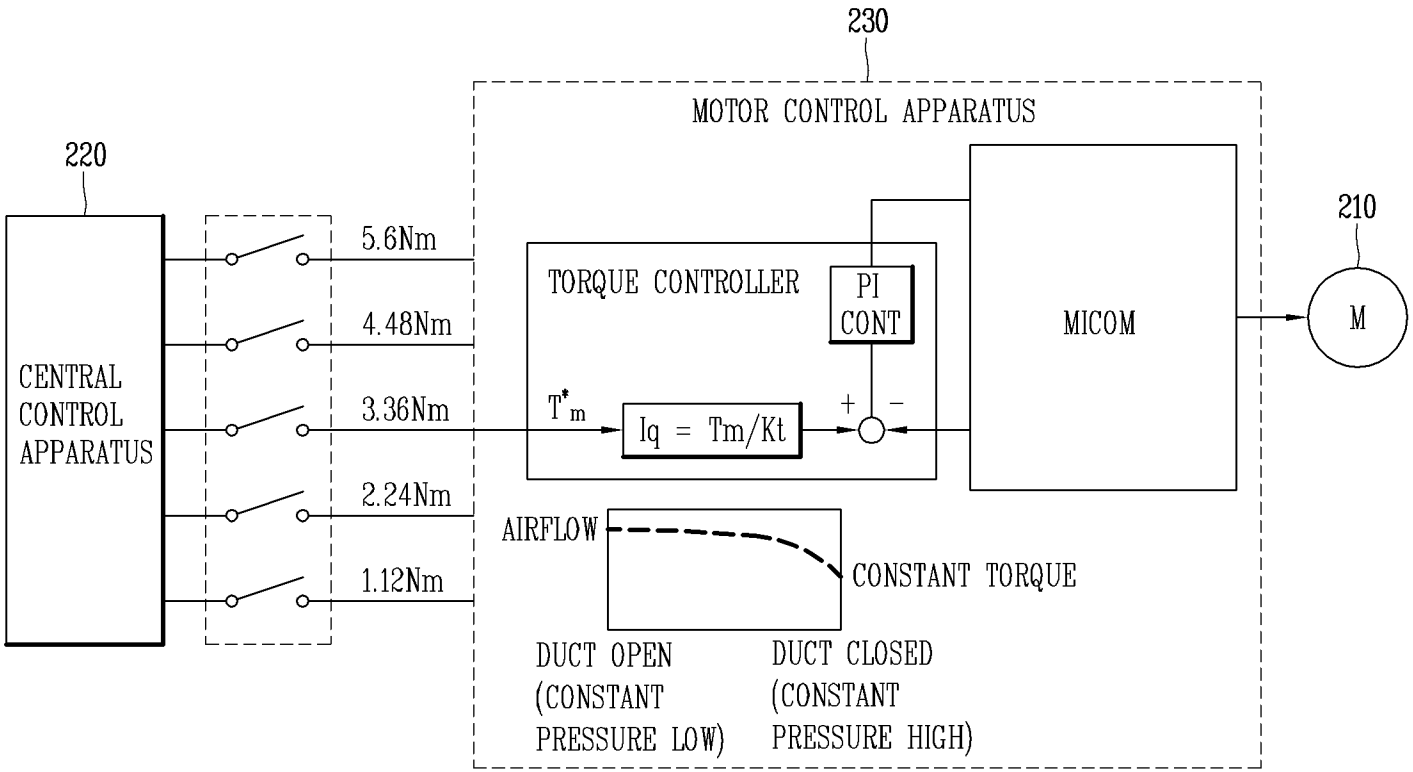
FIG. 1 is an exemplary diagram showing a constant torque control configuration in an air conditioning system.
Figure 2:
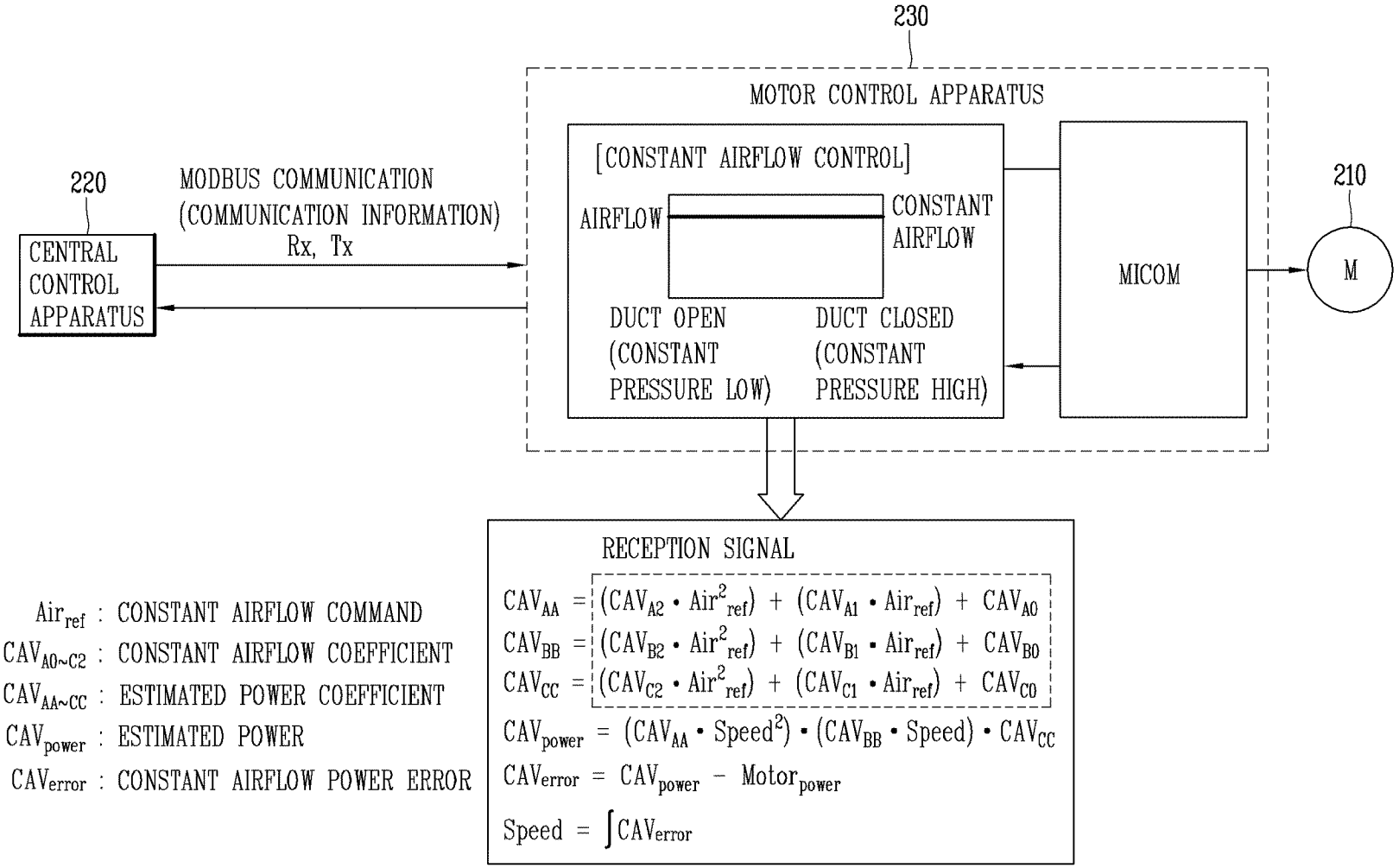
FIG. 2 is an exemplary diagram showing a constant airflow control configuration in an air conditioning system.

Embodiments disclosed herein may be described in detail with reference to the accompanying drawings, and the same or similar elements are designated with the same numeral references regardless of the numerals in the drawings and a redundant description thereof will be omitted, and in describing an embodiment disclosed herein, the detailed description will be omitted when specific description for publicly known technologies to which the invention pertains is judged to obscure the gist of the present disclosure.

The accompanying drawings may be provided only for a better understanding of the embodiments disclosed herein and are not intended to limit technical concepts disclosed herein, and therefore, it should be understood that the accompanying drawings include all modifications, equivalents and substitutes within the concept and technical scope of the present disclosure.

Figure 3:
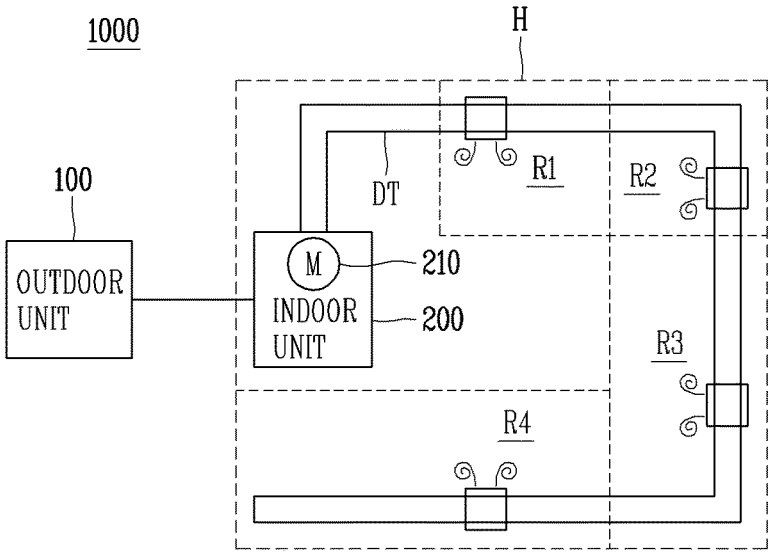
FIG. 3 is a block diagram of an air conditioning system according to an embodiment.
Figure 4:
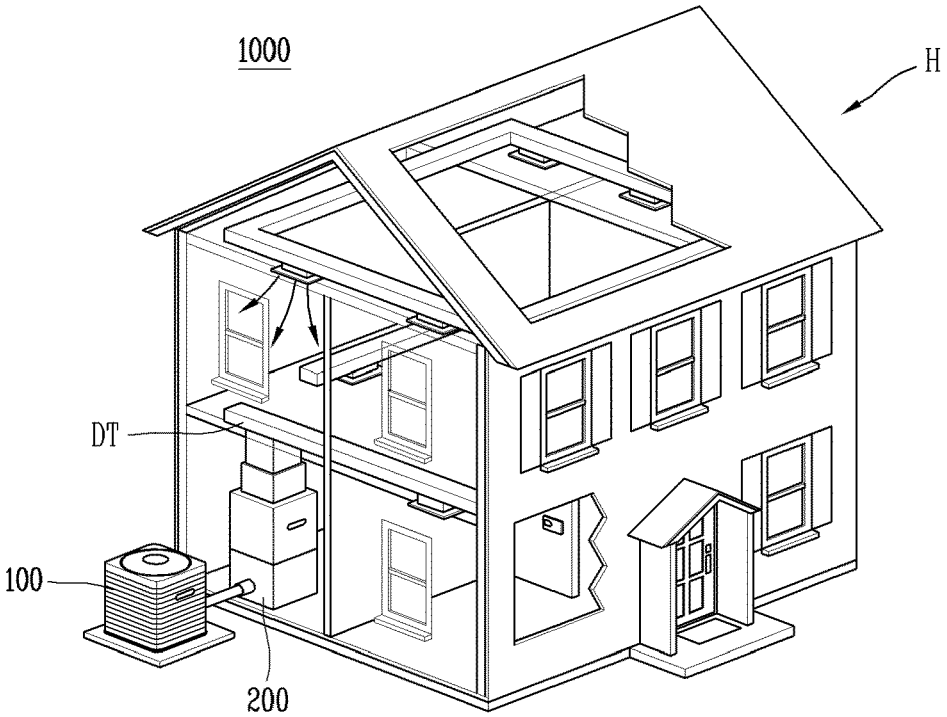
FIG. 4 is a detailed exemplary diagram of the air conditioning system shown in FIG. 3.

As shown in FIGS. 3 and 4, an air conditioning system 1000, including an outdoor unit 100 and an indoor unit 200, may be a system that performs air conditioning on an air conditioning target building H. The air conditioning system 1000 may refer to a heating ventilation air conditioning (HVAC) system.

The outdoor unit 100 may be installed outside the air conditioning target building H, and the indoor unit 200 may be installed inside the air conditioning target building H. The indoor unit 200 may supply airflow through a duct DT to each of a plurality of rooms R1 to R4 (in the air conditioning target building H) to perform air conditioning.

The indoor unit 200 may include a fan motor 210 to supply airflow to the plurality of rooms R1 to R4 by driving the fan motor 210. The fan motor 210 may be an electronically commutated motor (ECM) or a brushless direct current (BLDC) motor, for example.

Figure 5:
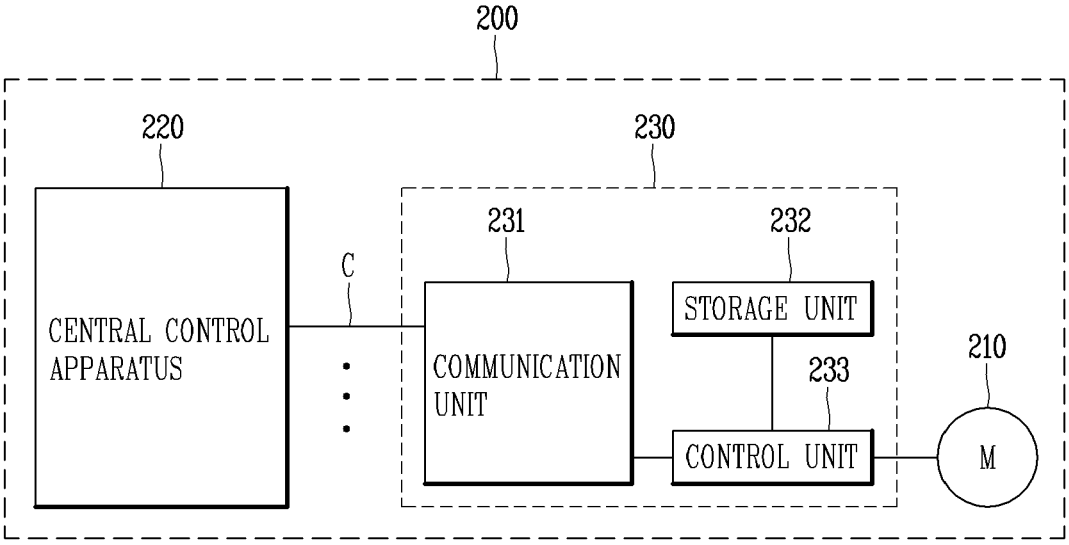
FIG. 5 is a configuration diagram of a motor control apparatus and an indoor unit including the same according to an embodiment.

As shown in FIG. 5, the indoor unit 200 (in the air conditioning system 1000) may include the fan motor 210, a central control apparatus 220, and a motor control apparatus 230 (or fan motor control apparatus) that controls the fan motor 210.

The central control apparatus 220, which may be a central control apparatus of the air conditioning system 1000, may control the outdoor unit 100 and the indoor unit 200 to control air conditioning. The central control apparatus 220 may transfer a signal for a control command to the motor control apparatus 230 according to an operating state of the air conditioning system 1000, thereby allowing the motor control apparatus 230 to control operation of the fan motor 210.

For example, the signal may be transferred to the motor control apparatus 230 to allow the indoor unit 200 to perform constant airflow control, thereby controlling the constant airflow through operation control of the fan motor 210.

As shown in FIG. 5, the motor control apparatus 230 may include a communication unit 231 (or communication device) that receives a signal from the central control apparatus 220 (of the indoor unit 200) through a communication line C, a storage unit 232 (or storage device) that stores information for controlling the indoor unit 200, and a control unit 233 (or a controller) that controls an operation of the fan motor 210 based on a result of receiving the signal and the information stored in the storage unit 232. The communication unit 231, the storage unit 232 and/or the control unit 233 may each be a specific structure to perform specific features. The specific structures may be physically coupled to other structures. The storage unit may also be referred to as a memory or memory device.

The central control apparatus 220 and the motor control apparatus 230 may communicate with each other through the communication line C. The communication line C may be a one-way communication line through which a signal is transmitted from the central control apparatus 220 to the motor control apparatus 230.

The indoor unit 200 may perform one-way communication from the central control apparatus 220 to the motor control apparatus 230.

The communication line C may be configured as a plurality of lines. Alternatively, the communication line C may be configured with a single line. That is, the communication line C may be one or more communication lines.

In an example of the communication line C configured in plurality, each of the plurality of communication lines C may be provided between the central control apparatus 220 and the communication unit 231 to perform communication between the central control apparatus 220 and the communication unit 231.

The central control apparatus 220 may transmit a signal through the communication line C to the communication unit 231 for a control command of the indoor unit 200. The signal may be a pulse signal or a digital signal having a predetermined magnitude. The signal may be a simple electrical signal having only a predetermined magnitude.

The communication unit 231 may receive an electrical signal from the central control apparatus 220 through the communication line C. The motor control apparatus 230 may control operation of the fan motor 210 based on the simple electrical signal.

Figure 6:
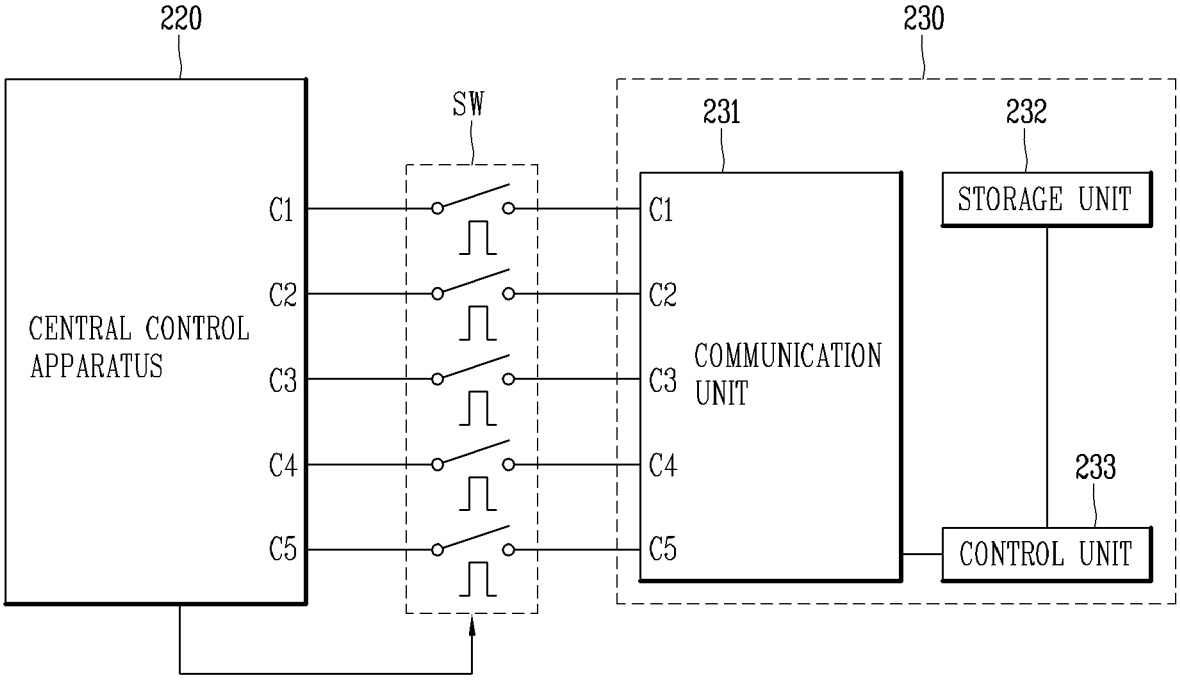
FIG. 6 is Exemplary Diagram 1 of a motor control apparatus according to an embodiment.

FIG. 6 shows an embodiment of the motor control apparatus 230 (including the communication unit 231, the storage unit 232, and the control unit 233) that controls the operation of the fan motor 210.

As shown in FIG. 6, the motor control apparatus 230 includes the communication unit 231 that receives a signal from the central control apparatus 220 through a plurality of communication lines C (C1 to C5), the storage unit 232 in which a control command value for controlling the indoor unit 200 is stored as table information corresponding to a reception pattern of the signal through the plurality of communication lines C, and the control unit 233 that determines an airflow command value to be supplied to a room in which the indoor unit 200 is installed based on a result of receiving the signal and the table information to control operation of the fan motor 210 based on the airflow command value.

In the motor control apparatus 230, the communication unit 231 receives the signal through the plurality of communication lines C, and the control unit 233 determines the airflow command value based on a result of receiving the signal by the communication unit 231 and the table information stored in the storage unit 232 to control operation of the fan motor 210 so as to supply airflow according to the airflow command value to the room.

The central control apparatus 220 may calculate (or determine) the airflow command value according to the operating state of the air conditioning system 1000 using the table information that has been prestored, and determine the reception pattern corresponding to the airflow command value based on the table information to transmit the signal to the motor control apparatus 230 through the plurality of communication lines C according to the reception pattern.

The plurality of communication lines C may include five or more communication lines C1 to C5.

The communication unit 231 may receive the signal from the central control apparatus 220 through each of the five communication lines C1 to C5.

The communication unit 231 may receive the signal from at least one of the plurality of communication lines C according to a pattern in which the central control apparatus 220 transmits the signal, but may not receive the signal from the other communication lines.

Accordingly, a result of the reception may define pattern information according to reception or non-reception of the signal in each of the plurality of communication lines C. For example, the reception and non-reception of the signal in each of the first communication line C to the fifth communication line C5 may be set to one and zero, respectively, thereby defining pattern information on signal reception/non-reception in each communication line.

On the other hand, each of the plurality of communication lines C may be provided with a switching element SW that is switched by the central control apparatus 220 to perform communication such that the signal is transmitted to the communication unit 231 from the central control apparatus 220 through the switching element SW.

In this example, when the central control apparatus 220 intends to transmit the signal to the communication unit 231, the switching element SW of the communication line C through which the signal is to be transmitted may be turned on to transmit the signal through the communication line C corresponding to the turned-on switching element.

That is, when transmitting the signal to the communication unit 231, the central control apparatus 220 may selectively switch a part of the switching elements SW of the plurality of communication lines C, respectively, to selectively transmit the signal to the communication line C of the switched switching element SW.

For example, when transmitting the signal through the first communication line C1 and the third communication line C3, the central control apparatus 220 may turn on the switching elements SW of the first communication line C1 and the third communication line C3, and turn off the switching elements SW of the second communication line C2, the fourth communication line C4, and the fifth communication line C5 such that the first communication line C1 and the third communication line C3 are connected to the communication unit 231, thereby transmitting the signal to the communication unit 231 through the first communication line C1 and the third communication line C3.

According to the switching element SW, the communication unit 231 may receive the signal through the corresponding communication line when the switching element SW is turned on, but may not receive the signal through the corresponding communication line when the switching element SW is turned off.

The reception pattern may be a pattern in which the communication unit 231 receives the signal through the plurality of communication lines C as described above. The reception pattern may be a pattern according to the reception or non-reception of the signal through each of the plurality of communication lines C. For example, the reception pattern may be expressed as [0, 0, 0, 0, 0] according to the reception (1) or non-reception (0) of the signal of each of the first communication line C1 to the fifth communication line C5, and for a specific example, when the signal is received through the first communication line C1, the third communication line C3, and the fifth communication line C5, the reception pattern may be expressed as [1, 0, 1, 0, 1].

As shown in FIG. 7, the table information may be information stored in a table form in which the control command value corresponds to each of the reception patterns. For example, as shown in FIG. 7, in an example of 5 communication lines C, the control command value may be provided and stored in a table form for each of 32 patterns that are the 5th power of two cases of signal reception/non-reception for each of the 5 communication lines.

Accordingly, the control unit 233 may determine a control command value corresponding to the reception result as the airflow command value based on the reception result and the table information. That is, the control unit 233 may determine the airflow command value based on a control command value from the table information corresponding to a pattern corresponding to the reception result.

As one example shown in FIG. 7, a control command value 100 [CFM] corresponding to [0, 0, 0, 0, 1] from the table information may be determined as the airflow command value when the signal is received from only the fifth communication line C5 (among the plurality of communication lines C). As another example, a control command value 900 [CFM] corresponding to [1, 1, 1, 1, 0] from the table information may be determined as the airflow command value when the signal is not received only from the fifth communication line C5 (among the plurality of communication lines C).

Figure 8:
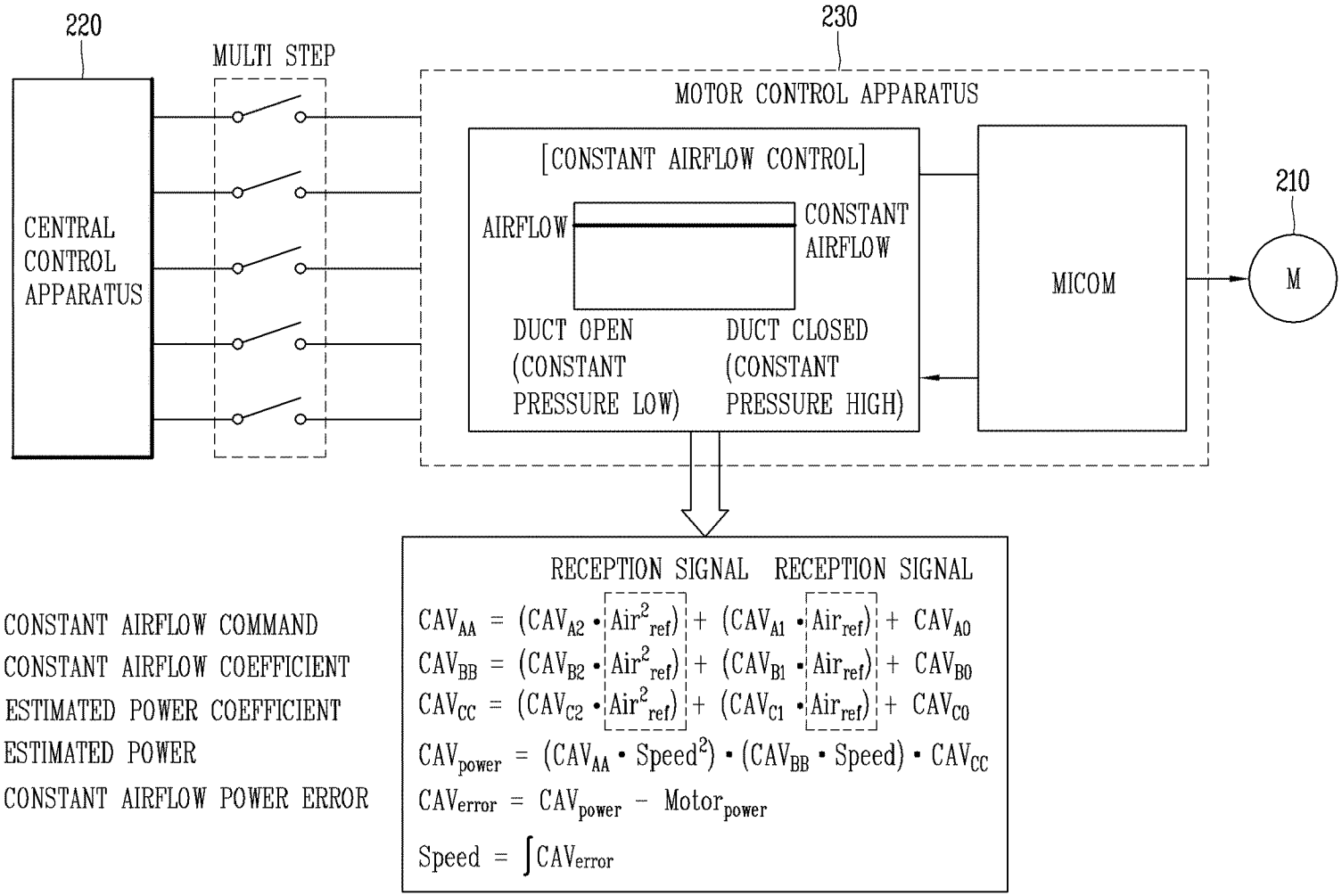
FIG. 8 is an exemplary diagram of a constant airflow control configuration according to the embodiment shown in FIG. 6.

That is, as shown in FIG. 8, the control unit 233 may determine the airflow command value corresponding to a pattern of the reception result by using the table information without receiving signal/information on the airflow command value from the central control apparatus 220.

For example, at least one of required power, torque, and/or speed of the fan motor 210 that can be controlled according to the airflow command value may be estimated to allow the fan motor 210 to be controlled to operate the fan motor 210 according to the estimated result. Accordingly, the control unit 233 may control operation of the fan motor 210 to perform air conditioning according to the airflow command value.

In the motor control apparatus 230, the storage unit 232 may store parameter information for controlling the airflow of the indoor unit, and the control unit 233 may calculate control information for controlling the constant airflow based on the airflow command value and parameter information to control the operation of the fan motor 210 so as to allow constant airflow to be supplied to the room based on the control information. Accordingly, the motor control apparatus 230 may perform the constant airflow control.

Figures 9, 10:
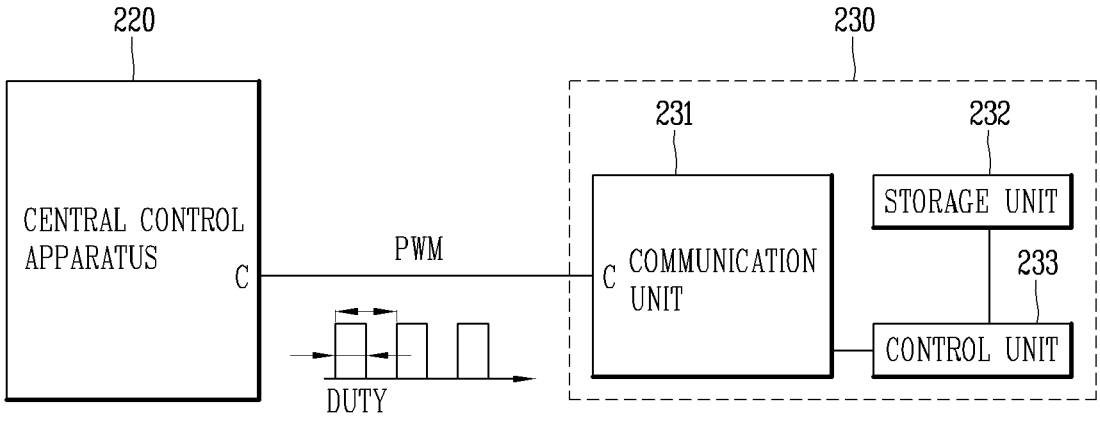
FIG. 9 is Exemplary Diagram 2 of a motor control apparatus according to an embodiment.
FIG. 10 is an exemplary diagram of table information according to the embodiment shown in FIG. 9.

FIG. 9 shows an embodiment of the motor control apparatus 230 (including the communication unit 231, the storage unit 232, and the control unit 233) that controls operation of the fan motor 210. As shown in FIG. 9, the motor control apparatus 230 includes the communication unit 231 that receives a PWM signal from the central control apparatus 220 through a communication line C, the storage unit 232 in which a control command value for controlling the indoor unit 200 is stored as table information corresponding to a duty ratio of the PWM signal, and the control unit 233 that determines an airflow command value to be supplied to a room (in which the indoor unit 200 is installed) based on a result of receiving the PWM signal and the table information to control the operation of the fan motor 210 based on the airflow command value.

In the motor control apparatus 230, the communication unit 231 receives the PWM signal through the communication line C, and the control unit 233 determines the airflow command value based on a result of receiving the PWM signal by the communication unit 231 and the table information stored in the storage unit 232 to control the operation of the fan motor 210 so as to supply airflow according to the airflow command value to the room.

The central control apparatus 220 may calculate the airflow command value according to the operating state of the air conditioning system 1000 by using the table information that has been prestored, and determine a duty ratio of the PWM signal corresponding to the airflow command value based on the table information to transmit the PWM signal to the motor control apparatus 230 through the communication line C according to the duty ratio.

The communication line C may be a dedicated communication line through which the PWM signal is transferred. That is, the communication unit 231 may receive the PWM signal from the central control apparatus 220 through a dedicated communication line C.

The PWM signal transmitted from the central control apparatus 220 may have a different duty ratio according to the control command value. That is, a result of receiving the PWM signal may be a result of a duty ratio of the PWM signal.

For example, the duty ratio may be represented by 10% to 90%, which may be referred to as a 10% duty cycle to 90% duty cycle.

As shown in FIG. 10, the table information may be information stored in a table form in which the control command value corresponds to the duty ratio. For example, as shown in FIG. 10, the control command value may be provided and stored in a table form for each of a plurality of adjustable duty ratios of the PWM signal.

Accordingly, the control unit 233 may determine a control command value corresponding to the reception result as the airflow command value based on the reception result and the table information. That is, the control unit 233 may determine the airflow command value based on a control command value corresponding to a duty ratio (corresponding to the reception result from the table information).

As shown in FIG. 10, for example, a control command value 1200 [CFM] corresponding to 20% (or 20% duty cycle) from the table information may be determined as the airflow command value when the duty ratio of the received PWM signal is 20%. A control command value 2000 [CFM] corresponding to 90% from the table information may be determined as the airflow command value when the duty ratio of the received PWM signal is 90%.

Figure 11:
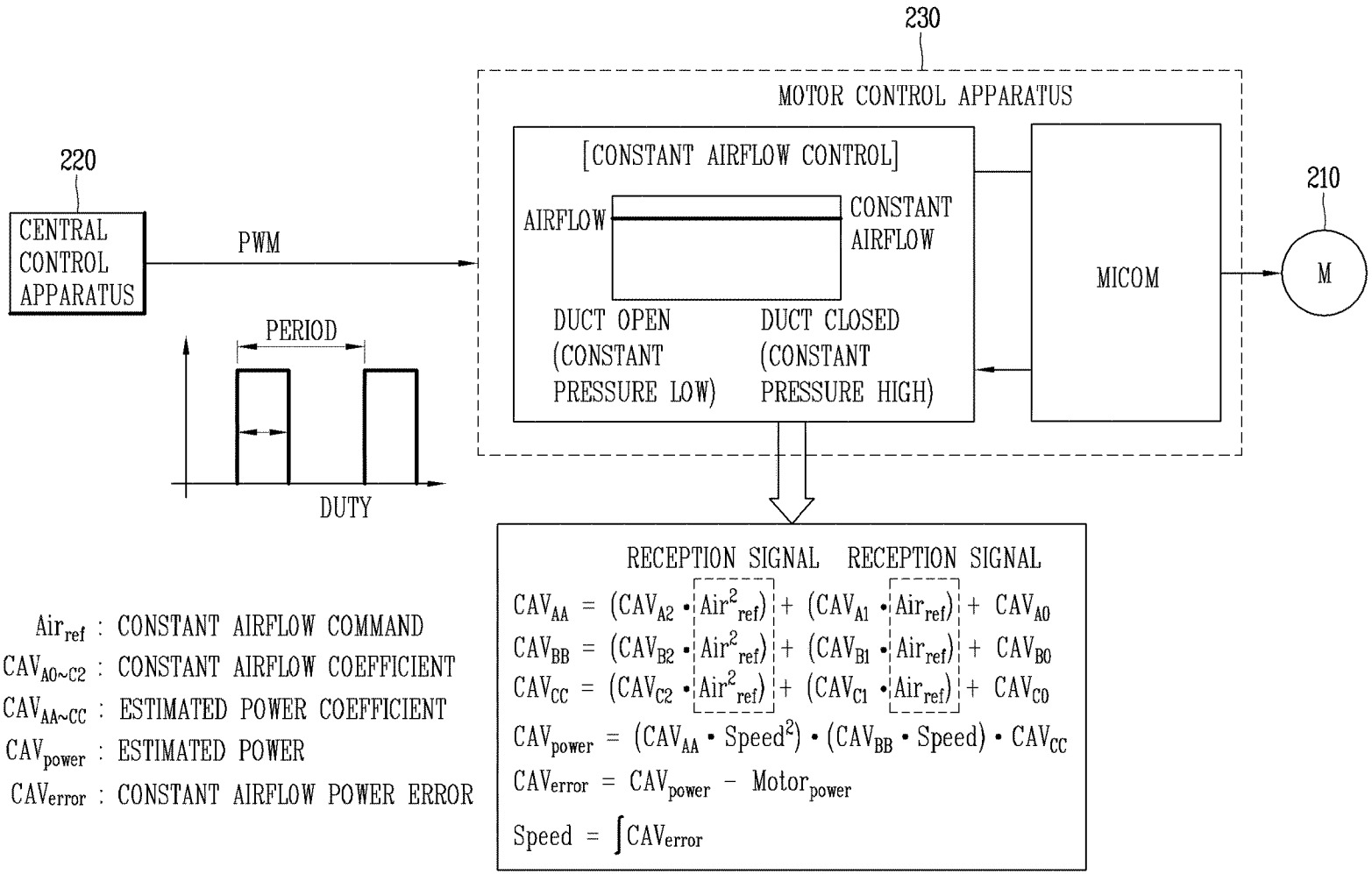
FIG. 11 is an exemplary diagram of a constant airflow control configuration according to the embodiment shown in FIG. 9.

That is, as shown in FIG. 11, the control unit 233 may determine the airflow command value corresponding to a duty ratio of the reception result by using the table information without receiving signal/information on the airflow command value from the central control apparatus 220.

For example, at least one of required power, torque, and/or speed of the fan motor 210 that can be controlled according to the airflow command value may be estimated to allow the fan motor 210 to be controlled to operate the fan motor 210 according to the estimated result. Accordingly, the control unit 233 may control the operation of the fan motor 210 to perform air conditioning according to the airflow command value.

In the motor control apparatus 230, the storage unit 232 may store parameter information for controlling the airflow of the indoor unit, and the control unit 233 may calculate control information for controlling the constant airflow based on the airflow command value and parameter information to control the operation of the fan motor 210 so as to allow constant airflow to be supplied to the room based on the control information. Accordingly, the motor control apparatus 230 may perform the constant airflow control.

Figure 12:
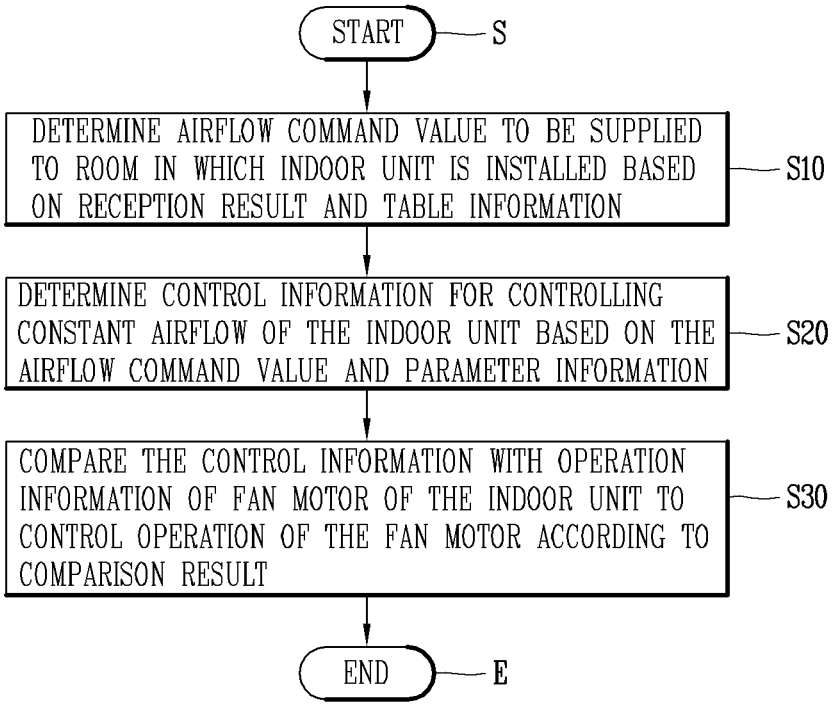
FIG. 12 is a flowchart of a constant airflow control method of a motor control apparatus according to an embodiment.

FIG. 12 shows a constant airflow control method in which the motor control apparatus 230 performs the constant airflow control.

The constant airflow control method, which is a method in which the motor control apparatus, including the communication unit 231 that receives a signal from the central control apparatus 220 through one or more communication lines C, the storage unit 232 in which table information of the control command value corresponding a reception pattern of the signal and the parameter information are stored, and the control unit 233 that controls the fan motor 210 based on a result of receiving the signal and the information stored in the storage unit 232, performs the constant airflow control, as shown in FIG. 6. The method may include determining an airflow command value to be supplied to a room in which the indoor unit 200 is installed based the reception result and the table information (S10), determining control information for controlling the constant airflow control of the indoor unit 200 based on the airflow command value and the parameter information (S20), and comparing the control information with the operation information of the fan motor of the indoor unit to control the operation of the fan motor 210 according to the comparison result (S30) as shown in FIG. 12.

The motor control apparatus 230 may perform E the constant airflow control using a process of determining, by the control unit 233, the airflow command value based the reception result and the table information when the communication unit 231 receives (S) the signal through the communication line C (S10), determining the control information based on the airflow command value and the parameter information (S20), and comparing the control information with the operation information to control the operation of the fan motor 210 according to the comparison result (S30).

The determining of the airflow command value (S10) may determine the airflow command value based on a control command value corresponding to a pattern corresponding to the reception result from the table information as shown in FIG. 7.

The constant airflow control method, which is a method in which the motor control apparatus, including the communication unit 231 that receives a PWM signal from the central control apparatus 220 through a communication line C, the storage unit 232 in which table information of the control command value corresponding a duty ratio of the PWM signal and the parameter information are stored, and the control unit 233 that controls the fan motor 210 based on a result of receiving the PWM signal and the information stored in the storage unit 232, performs the constant airflow control, as shown in FIG. 9. The method may include determining an airflow command value to be supplied to a room in which the indoor unit 200 is installed based the reception result and the table information (S10), determining control information for controlling the constant airflow control of the indoor unit 200 based on the airflow command value and the parameter information (S20), and comparing the control information with the operation information of the fan motor of the indoor unit to control the operation of the fan motor 210 according to the comparison result (S30) as shown in FIG. 12.

The motor control apparatus 230 may perform (E) the constant airflow control using a process of determining, by the control unit 233, the airflow command value based the reception result and the table information when the communication unit 231 receives (S) the PWM signal through the communication line C (S10), determining the control information based on the airflow command value and the parameter information (S20), and comparing the control information with the operation information to control the operation of the fan motor 210 according to the comparison result (S30).

The determining of the airflow command value may determine the airflow command value based on a control command value corresponding to a duty ratio corresponding to the reception result from the table information as shown in FIG. 10.

Figure 13:
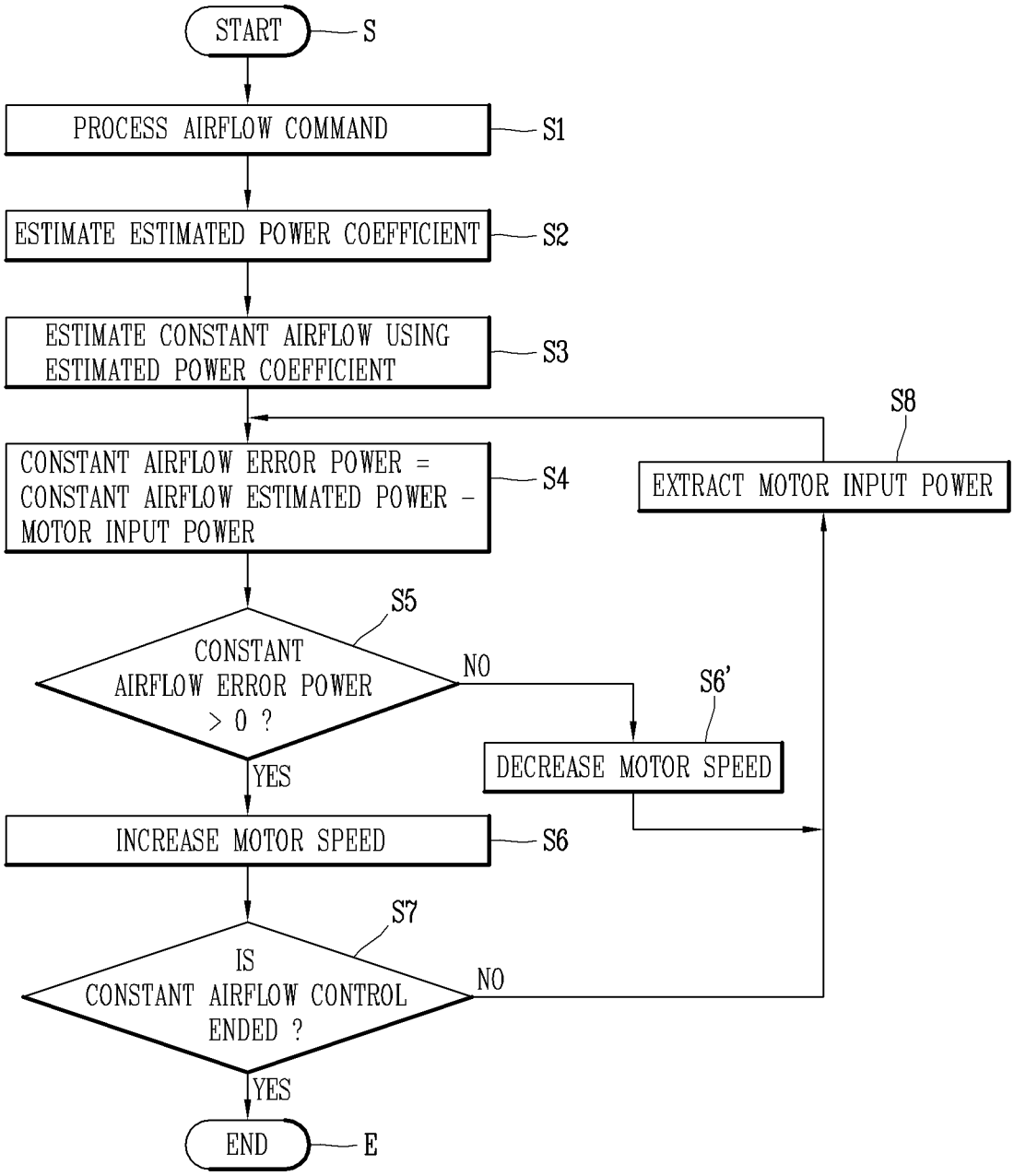
FIG. 13 is a flowchart showing a specific example of a constant airflow control process.

A specific constant airflow control process according to the motor control apparatus 230 and the constant airflow control method may be shown in FIG. 13.

When the communication unit 231 receives the signal from the central control apparatus 220, the control unit 233 may process the airflow command value based on a control command value corresponding to a result of receiving the signal from the table information (S1), estimate an estimated power coefficient and constant airflow power for airflow control based on the airflow command value and the parameter information (S2 and S3) to derive constant airflow error power from a difference between the constant airflow power and the input power of the fan motor 210 (S4), determine that airflow supply needs to be increased because airflow required for constant airflow is insufficient when the constant airflow error power is positive (S5) to increase an operating speed of the fan motor 210 (S6), and then extract the input power of the fan motor 210 (S8) depending on whether the constant airflow control is terminated (S7) to re-derive the constant airflow error power (S4), and determine that the airflow supply needs to be decreased because airflow required for constant airflow is in excess when the constant airflow error power is negative (S5) to decrease the operating speed of the fan motor 210 (S6'), and then extract the input power of the fan motor 210 (S8) to re-derive the constant airflow error power (S4).

The airflow command value may be determined based on the reception result, and the control information required for the constant airflow control may be determined based on the airflow command value and the parameter information to increase or decrease an operating speed of the fan motor 210 according to a result of comparing the control information with the operation information of the fan motor 210, that is, the input power, to perform constant airflow control.

Embodiments of the present disclosure may overcome limitations of disadvantageous arrangements as described above.

An aspect of the present disclosure is to provide embodiments of a motor control apparatus, an air conditioning system, and a constant airflow method of a fan motor control apparatus of an indoor unit that can perform constant airflow control through one-way communication.

Another aspect of the present disclosure is to provide embodiments of a motor control apparatus, an air conditioning system, and a constant airflow control method of a fan motor control apparatus of an indoor unit that can minimize transmission of command values and parameter information for performing constant airflow control.

Still another aspect of the present disclosure is to provide embodiments of a motor control apparatus, an air conditioning system, and a constant airflow control method of a fan motor control apparatus of an indoor unit that can minimize a circuit configuration for constant airflow control.

Yet still another aspect of the present disclosure is to provide embodiments of a motor control apparatus, an air conditioning system, and a constant airflow control method of a fan motor control apparatus of an indoor unit that can reduce the cost of constructing the air conditioning system for air conditioning in a plurality of rooms with a single outdoor unit and a single indoor unit.

Another aspect of the present disclosure to provide embodiments of a motor control apparatus, an air conditioning system, and a constant airflow control method of a fan motor control apparatus of an indoor unit that can quickly and accurately perform constant airflow control.

In order to solve the above problems, embodiments of the present disclosure may determine a command value based on a reception pattern or type of a signal to perform control as a problem solving means.

A control command value for controlling an indoor unit may be prestored as table information corresponding to the reception pattern of the signal through a communication line, and an airflow command value to be supplied to a room where the indoor unit is installed may be determined based on a reception result of the signal and the table information to control an operation of the fan motor of the indoor unit based on the airflow command value.

In embodiments of the present disclosure, table information on an airflow command value corresponding to the reception pattern or type of a signal may be prestored in the motor control apparatus, and a corresponding airflow command value from the table information may be determined according to a result of receiving the signal from a central control apparatus to control an operation of a fan motor so as to perform airflow control without transmitting/receiving a signal related to a control command or two-way communication, thereby solving the foregoing problems.

The technical features may be applied and implemented to a fan motor control apparatus of an indoor unit, an indoor unit control apparatus, an air conditioning control apparatus, an air conditioning system, a fan motor control apparatus of the air conditioning system, a communication method of the indoor unit, a communication method of the air conditioning system, a constant airflow control method of the indoor unit, a constant airflow control method of the air conditioning system, a communication method of a fan motor control apparatus of the indoor unit, a constant airflow control method of the fan motor control apparatus of the indoor unit, a communication method of the indoor unit control apparatus, and a constant airflow control method of the indoor unit control apparatus, and the present disclosure is to provide embodiments of a motor control apparatus, an air conditioning system, and a constant airflow control method of a fan motor control apparatus of an indoor unit as a problem solving means.

An embodiment of a motor control apparatus having the foregoing technical features as a problem solving means, which is a motor control apparatus that controls a fan motor of an indoor unit, may include a communication unit that receives a signal from a central control apparatus of the indoor unit through a plurality of communication lines, a storage unit that stores a control command value for controlling the indoor unit as table information corresponding to a reception pattern of the signal through the plurality of communication lines, and a control unit that determines an airflow command value to be supplied to a room in which the indoor unit is installed based on a result of receiving the signal and the table information to control an operation of the fan motor based on the airflow command value.

The technical features may be implemented as an embodiment of a constant airflow control method of a fan motor control apparatus of an indoor unit.

An embodiment of a constant airflow control method of a fan motor control apparatus of an indoor unit having the foregoing technical features as a problem solving means may be a constant airflow control method of a fan motor control apparatus of an indoor unit, the fan motor control apparatus including a communication unit that receives a signal from a central control apparatus through one or more communication lines, a storage unit that stores table information of a control command value for controlling an indoor unit corresponding to a reception pattern of the signal and parameter information for controlling the airflow of the indoor unit, and a control unit that controls a fan motor of the indoor unit based on a result of receiving the signal and information stored in the storage unit, and the method may include determining an airflow command value to be supplied to a room in which the indoor unit is installed based on the reception result and the table information, determining control information for controlling constant airflow of the indoor unit based on the airflow command value and the parameter information, and comparing the control information with an operation information of the fan motor of the indoor unit to control an operation of the fan motor according to a result of the comparison.

Another embodiment of a motor control apparatus having the foregoing technical features as a problem solving means may include a communication unit that receives a PWM signal from a central control apparatus of the indoor unit through a communication line, a storage unit that stores a control command value for controlling the indoor unit as table information corresponding to a duty ratio of the PWM signal, and a control unit that determines an airflow command value to be supplied to a room in which the indoor unit is installed based on a result of receiving the PWM signal and the table information to control an operation of the fan motor based on the airflow command value.

The technical features may be implemented as another embodiment of a constant airflow control method of a fan motor control apparatus of an indoor unit.

Another embodiment of a constant airflow control method of a fan motor control apparatus of an indoor unit having the foregoing technical features as a problem solving means may be a constant airflow control method of a fan motor control apparatus of an indoor unit, the fan motor control apparatus including a communication unit that receives a PWM signal from a central control apparatus through a communication line, a storage unit that stores table information of a control command value for controlling an indoor unit corresponding to a duty ratio of the PWM signal and parameter information for controlling the airflow of the indoor unit, and a control unit that controls a fan motor of the indoor unit based on a result of receiving the PWM signal and information stored in the storage unit, and the method may include determining an airflow command value to be supplied to a room in which the indoor unit is installed based on the reception result and the table information, determining control information for controlling constant airflow of the indoor unit based on the airflow command value and the parameter information, and comparing the control information with an operation information of the fan motor of the indoor unit to control an operation of the fan motor according to a result of the comparison.

On the other hand, the above technical features may be implemented as an embodiment of an air conditioning system that performs air conditioning for a plurality of rooms through a duct.

An embodiment of an air conditioning system having the foregoing technical features as a problem solving means may be an air conditioning system including an outdoor unit, an indoor unit that supplies airflow to the plurality of rooms through the duct, a central control apparatus that controls the outdoor unit and the indoor unit to control air conditioning, and a motor control apparatus that controls a fan motor of the indoor unit based on a result of receiving a signal from the central control apparatus through one or more communication lines, wherein the motor control apparatus includes a communication unit that receives the signal from the central control apparatus through the one or more communication lines, a storage unit that stores table information of a control command value for controlling the indoor unit corresponding to a reception pattern of the signal and parameter information for controlling the airflow of the indoor unit, and a control unit that determines an airflow command value to be supplied to a room in which the indoor unit is installed based on a result of receiving the signal and the table information, and determines control information for controlling the constant airflow of the indoor unit based on the airflow command value and the parameter information to control an operation of the fan motor based on the control information.

Embodiments of a motor control apparatus, an air conditioning system, and a constant airflow control method of a fan motor control apparatus of an indoor unit as described above may determine a command value according to the reception pattern or type of a signal to perform the operation control of a fan motor so as to control an operation of the fan motor through one-way communication, thereby solving the foregoing problems.

The motor control apparatus, the air conditioning system, the constant airflow control method of the fan motor control apparatus of the indoor unit according to the embodiments may determine a command value according to the reception pattern or type of a signal to perform the operation control of a fan motor, thereby having an effect capable of controlling the operation of the fan motor through one-way communication.

Accordingly, there may be an effect capable of performing the constant airflow control of the fan motor of the indoor unit through one-way communication.

Furthermore, there may be an effect capable of minimizing the transmission of a command value and parameter information for performing constant airflow control.

There may be an effect capable of simplifying a circuit configuration for controlling constant airflow, and accordingly, there may be an effect capable of reducing the cost consumed in the design and construction of the air conditioning system.

There may be an effect of quickly and accurately performing constant airflow control with a simple communication configuration, as well as promoting the development of air conditioning control or various communication/control methods for the same.

As a result, the motor control apparatus, the air conditioning system, and the constant airflow control method of the fan motor control apparatus of the indoor unit according to the embodiments may provide an effect of overcoming the limitations of the related art as well as increasing the efficiency, utility, effectiveness, and usability of the air conditioning system.

Effects of the embodiments are not limited to the effects mentioned above, and other effects not mentioned will be clearly understood by those skilled in the art from the description of the claims.

Although the present disclosure has been described with respect to specific embodiments and drawings, the present disclosure is not limited to those embodiments, and it will be apparent to those skilled in the art that various changes and modifications can be made from the description disclosed herein. Consequently, the concept of the present disclosure should be construed in accordance with the appended claims, and all the same and equivalent changes will fall into the scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A motor control apparatus to control a fan motor of an indoor unit, the motor control apparatus comprising:

a communication device configured to receive a signal from a control apparatus of the indoor unit through a plurality of communication lines, the control apparatus is separate from the motor control apparatus;

a storage configured to store control command for controlling the indoor unit as table information corresponding to a reception pattern of the signal through the plurality communication lines; and a controller configured to determine an airflow command value to be supplied to a room in which the indoor unit is installed based on the stored table information and a result of receiving the signal, and to control operation of the fan motor based on the determined airflow command value, wherein the control apparatus is configured to calculate the airflow command value based on an operating state of the air conditioning system using the stored table information, and to determine the reception pattern corresponding to the airflow command value based on the stored table information so as to transmit the signal through the one or more communication lines according to the determined reception pattern.

2. The motor control apparatus of claim 1, wherein a total number of the plurality of communication lines is at least five.

3. The motor control apparatus of claim 1, wherein each of the plurality of communication lines is provided with a switching element that is switched by the control apparatus to perform communication so as to transmit the signal from the control apparatus to the communication device through the switching element.

4. The motor control apparatus of claim 3, wherein the communication device receives the signal through a corresponding communication line when the switching elements is on, and does not receive the signal through the corresponding communication line when the switching element is off.

5. The motor control apparatus of claim 1, wherein the reception pattern of the signal is a pattern corresponding to reception or non-reception of the signal through each of the plurality of communication lines.

6. The motor control apparatus of claim 1, wherein the controller is configured to determine the airflow command value based on a control command value corresponding to a pattern corresponding to the reception result from the table information.

7. The motor control apparatus of claim 1, wherein the storage is configured to store parameter information for controlling airflow of the indoor unit, wherein the controller is configured to determine control information for controlling constant airflow based on the determined airflow command value and the parameter information stored in the table information, and wherein the control information is to control operation of the fan motor so as to supply constant airflow to a room based on the determined control information.

8. An air conditioning system for performing air conditioning through a duct for a plurality of rooms, the system comprising:

the motor control apparatus of claim 1;

the indoor unit configured to provide airflow to the plurality of rooms through the duct;

an outdoor unit to communicate with the indoor unit; and the control apparatus configured to control the outdoor unit and the indoor unit to control air conditioning.

9. A motor control apparatus to control a fan motor of an indoor unit, the motor control apparatus comprising:

a communication device that configured to receive a pulse width modulation (PWM) signal from a control apparatus of the indoor unit through a communication line, the control apparatus is separate from the motor control apparatus;

a storage configured to store table information, the table information including a plurality of control command values and a corresponding duty ratio of a PWM signal for each of the plurality of control command values; and a controller configured to determine an airflow command value to be supplied to a room in which the indoor unit is installed based on the stored table information and a result of receiving the PWM signal, and to control operation of the fan motor based on the determined airflow command value, wherein the control apparatus is configured to calculate the airflow command value based on an operating state of an air conditioning system using the stored table information, and to determine the duty ratio corresponding to the airflow command value based on the stored table information so as to transmit the PWM signal through the communication line according to the determined duty ratio.

10. The motor control apparatus of claim 9, wherein the controller is configured to determine, from the stored table information, the airflow command value based on a specific one of the control command values corresponding to the duty ratio of the PWM signal received from the communication line.

11. The motor control apparatus of claim 9, wherein the storage is configured to store parameter information for controlling airflow of the indoor unit, wherein the controller is configured to determine control information for controlling constant airflow based on the determined airflow command value and the parameter information stored in the table information, and wherein the control information is to control operation of the fan motor so as to supply constant airflow to a room based on the determined control information.

12. An air conditioning system for performing air conditioning through a duct for a plurality of rooms, the system comprising:

the motor control apparatus of claim 9;

the indoor unit configured to provide airflow to the plurality of rooms through the duct;

an outdoor unit to communicate with the indoor unit;

the control apparatus configured to control the outdoor unit and the indoor unit for air conditioning.

13. An air conditioning system for performing air conditioning for a plurality of rooms through a duct, the air conditioning system, comprising:

an outdoor unit;

an indoor unit configured to provide airflow to the plurality of rooms through the duct;

a control apparatus configured to control the outdoor unit and the indoor unit to control air conditioning; and a motor control apparatus configured to control a fan motor of the indoor unit based on a result of receiving a signal from the control apparatus through one or more communication lines, wherein the motor control apparatus comprises:

a communication device configured to receive the signal through the one or more communication lines;

a storage configured to store table information, the table information including a plurality of control command values each separately corresponding to a reception pattern of a signal and parameter information for controlling airflow of the indoor unit; and a controller configured to receive the signal from the communication device, to determine an airflow command value based on the signal received from the communication device and based on the stored table information, and to determine control information for controlling constant airflow of the indoor unit based on the determined airflow command value and the parameter information, and to control operation of the fan motor based on the determined control information, and wherein the control apparatus is configured to calculate the airflow command value based on an operating state of the air conditioning system using the stored table information, and to determine the reception pattern corresponding to the airflow command value based on the stored table information so as to transmit the signal through the one or more communication lines according to the determined reception pattern.

14. The air conditioning system of claim 13, wherein the one or more communication lines includes at least five communication lines.

15. The air conditioning system of claim 13, wherein each of the one or more communication lines is associated with a separate switching element that is configured to be controlled so as to transmit the signal to the communication device.

16. The air conditioning system of claim 15, wherein when a first one of the switching elements is configured to be on, the communication device is to receive part of the signal through a corresponding communication line, and when a second one of the switching elements is configured to be off, the communication device is to not receive part the signal through a corresponding communication line.

17. The air conditioning system of claim 13, wherein the controller is configured to determine, from the stored table information, the airflow command value based on a specific one of the control command values corresponding to the reception pattern of the signal.

18. The air conditioning system of claim 13, wherein the reception pattern of the signal is a pattern corresponding to reception or non-reception of the signal through the one or more communication lines.

19. The air conditioning system of claim 13, wherein the storage is configured to store parameter information for controlling airflow of the indoor unit, wherein the controller is configured to determine control information for controlling constant airflow based on the determined airflow command value and the parameter information stored in the table information, and wherein the control information is to control operation of the fan motor so as to supply constant airflow to a room based on the determined control information.

* * * * *